US005503580A

United States Patent [19]

McCarthy

[11] Patent Number: 5,503,580

[45] Date of Patent: Apr. 2, 1996

[54] TENSION LOAD WATER SKI HANDLE SYSTEM

[75] Inventor: Kevin T. McCarthy, Redmond, Wash.

[73] Assignee: Straight Line Water Sports, Inc., Redmond, Wash.

[21] Appl. No.: 342,756

[22] Filed: Nov. 21, 1994

[51] Int. Cl.[6] ..... A63C 15/06

[52] U.S. Cl. ..... 441/69; 114/253

[58] Field of Search ..... 441/68, 69; 114/253; 16/110 R, 111 R, 125

[56] References Cited

U.S. PATENT DOCUMENTS

| | | | |
|---|---|---|---|
| 3,092,068 | 6/1963 | Brownson | 441/69 |
| 3,537,418 | 11/1970 | Brownson | 441/69 |
| 4,043,290 | 8/1977 | Holland | 441/69 |
| 4,060,049 | 11/1977 | Rumbaugh | 441/69 |
| 4,182,258 | 1/1980 | Presser | 441/69 |
| 4,540,371 | 9/1985 | Taylor | 441/69 |
| 4,740,181 | 4/1988 | Kell | 441/69 |
| 4,863,407 | 9/1989 | Casad | 441/69 |
| 5,052,964 | 10/1991 | Pittman | 441/69 |
| 5,207,606 | 5/1993 | Pittman | 441/69 |

*Primary Examiner*—Edwin L. Swinehart
*Attorney, Agent, or Firm*—Craine & Jackson

[57] ABSTRACT

A water ski handle system designed to partially absorb and evenly distribute forces generated on the handle component and tow line while skiing. The handle system includes a handle component with two L-shaped corner struts attached to its opposite, opened ends. Each corner strut includes a rigid bushing member which mechanically connects to an end on the handle component, and a perpendicularly aligned long leg member which projects in a forward direction parallel to the longitudinal axis of the main tow line. A continuous, L-shaped inner passageway is formed inside each corner strut through which the end of the tow line passes to connect to the handle component. The corner radius of the inner passageway is relatively large so that point loading on the tow line is substantially reduced. The long leg member is substantially rigid along its horizontal "x" and "y" axis yet sufficiently flexible along its "z" axis which enables the long leg member to bend inward towards the extended longitudinal axis of the main tow line when sufficient tension force is exerted thereon. The tow line exits from handle component from the forward projecting, distal end of the long leg member thereby providing the user a mechanical advantage to prevent rotation of the handle component in the skier's hand during use.

21 Claims, 4 Drawing Sheets

TENSION LOAD WATER SKI HANDLE SYSTEM

BACKGROUND OF THE INVENTION

1. Field of the Invention

This invention pertains to buoys, rafts and aquatic devices and, more particularly, to water ski tow handles.

2. Description of the Related Art

Water ski handles found in the prior art include the following U.S. Pat. Nos: 3,092,068, 3,537,418, 4,043,290, 4,060,049, 4,182,258, 4,540,371, 4,740,181, 4,863,407, 5,052,964 and 5,207,606. One important drawback with these water ski handles is that great force loads are exerted on the specific sections of the handle and rope which, with continued use, cause failure.

One possible method for reducing handle and rope failures is to use a handle and rope system capable of partially absorbing and evenly distributing the forces exerted thereon during use to various components specifically designed to withstand these forces.

Another important drawback with water ski handles found in the prior art is that they have a tendency to rotate in the skier's hand during use thereby reducing the skier's control.

SUMMARY OF THE INVENTION

It is an object of the invention to provide a water ski handle system.

It is an object of the invention to provide a water ski handle system designed to partially absorb and to evenly distribute the forces exerted thereon during use.

It is another object of the present invention to provide a water ski handle system which provides greater control for the skier.

Accordingly, disclosed herein is a water ski handle system comprising a handle component with two, L-shaped corner struts attached to the opposite ends thereof. The handle component, which is designed to be held by one or both hands of the user, includes an elongated hollow tube with the corner struts attached to the opened ends thereof. Manufactured inside each corner strut is a continuous L-shaped inner passageway through which the branch tow line on a bridle passes to attach to the handle component. The corner radius of the inner passageway is gently curved so that point loading on the branch line is reduced during use.

Structurally, each corner strut comprises a short leg member and an integrally attached, perpendicularly aligned long leg member. The short leg member includes a rigid bushing member specifically designed to withstand the forces exerted by the branch tow line on the end of the handle component. The bushing member is also designed to be forcibly inserted into the opened end of the hollow tube to securely attach the corner strut thereto. The long leg member is designed to project in a forward direction from the bushing member parallel to the longitudinal axis of the tow line. When assembled, the branch tow line passes through the opening on the distal end of the long leg member, along the inner passageway, and through the opening located on the proximal end of the bushing member. The end of the branch tow line may be tied in a large knot or tied to the end of the branch tow line passing through the opposite corner strut. Alternatively, the branch tow line may run continuously through the handle component and out the other corner strut and then tie or fasten to the branch tow line or main tow line located down-line from the handle component.

The long leg member is specifically designed to partially absorb a portion of the tension force exerted on the branch tow line during use. This force absorbing feature is accomplished by the long leg member being able to bend inward toward the extended center axis of the main tow line when a sufficient amount of tension force is exerted thereon. The long leg member is oval-shaped in cross-section so that its "z" axis is shorter than its "x" axis. The long leg member also has unique first and second molded layers molecularly bonded together which provide sufficient rigidity to enable the long leg member to remain perpendicularly aligned with the longitudinal axis of handle component at all times during use. The first and second molded layers also provide sufficient flexibility to enable the long leg member to selectively bend inward towards the extended center axis of the main tow line when a sufficient amount of tension force is exerted thereon. Since the distal end of the long leg member is disposed in front of the longitudinal axis of the handle component, the fulcrum between the handle component and the branch tow line is disposed in front of the handle component, which gives the skier a mechanical advantage to resist rotation of the handle component in the skier's hand during use.

The above handle system may be used with two main tow lines both attached to the stern of the ski boat or with one main tow line with a y-shaped tow section or bridle attached at one end. When used with a y-shaped tow section or bridle, an optional yoke member may be disposed over the y-shaped intersection. The yoke member has two branching arms, similar in construction to the long leg member of the corner strut, which are designed to bend inward towards the extended center axis of the main tow line when sufficient tension force is exerted thereon. This feature acts to further reduce the tension forces exerted on the two branch tow lines.

In summary, the corner struts and yoke member operate to markedly reduce failures of the branch tow lines and handle component by using structural elements designed to withstand the tension forces, to partially absorb the forces, and to evenly distribute the forces exerted on the branch tow lines, and to improve the skier's control.

DESCRIPTION OF THE PREFERRED EMBODIMENT

Referring to FIGS. 1–8, there is shown a water ski handle system, denoted by reference number 5, designed to reduce and more evenly distribute the tension forces F(2) exerted on the two branch tow lines 12 on a water ski rope bridle (shown) or a single tow line. By reducing and evenly distributing the tension forces F(2), failure of the branch tow lines 12 and handle component 20 during normal use are substantially reduced. The handle system 5 is also designed to provide greater control for the water skier.

Figure 1:
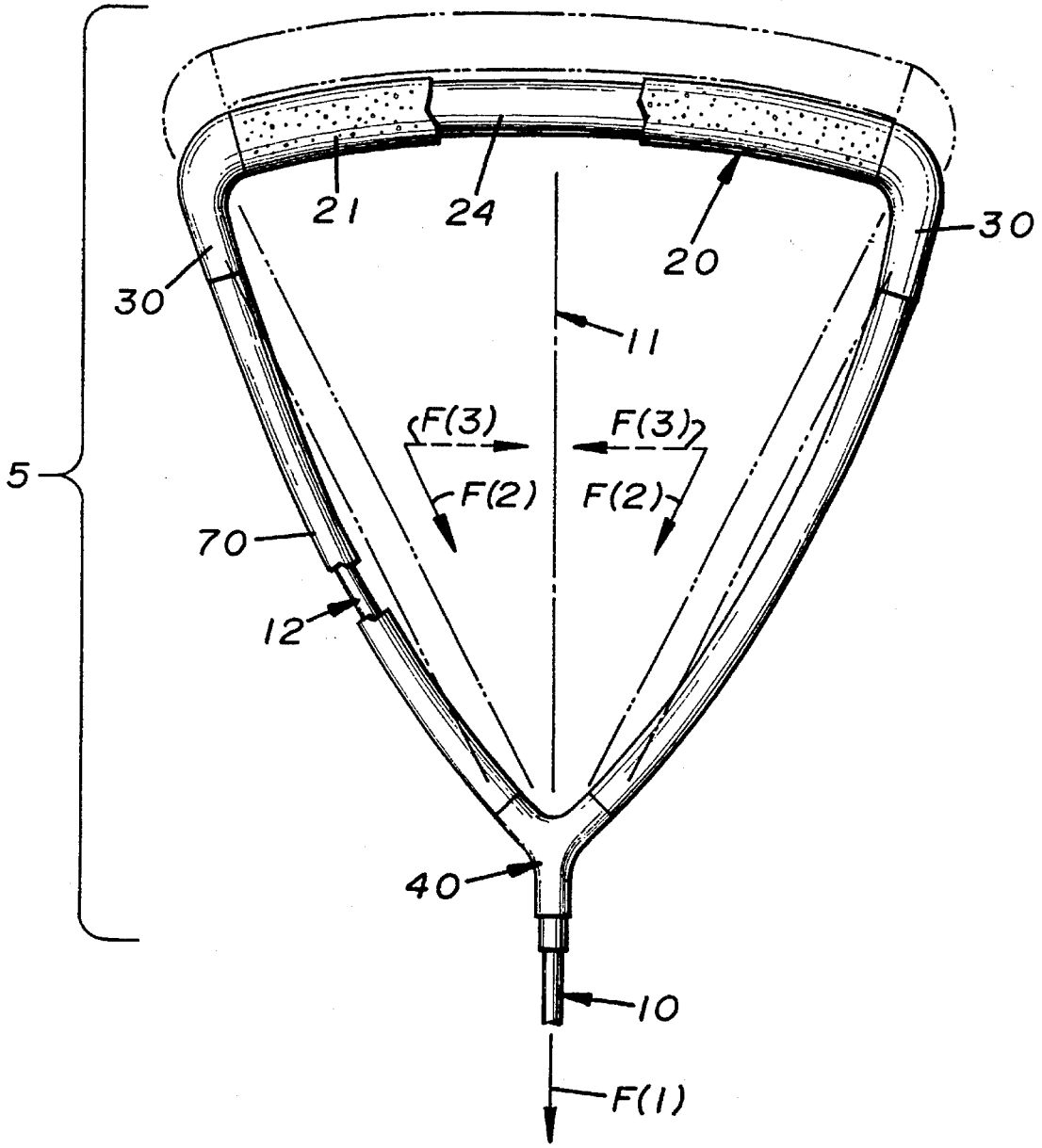
FIG. 1 is a top plan view of the water ski handle disclosed herein used on a bridle.
Figure 2:
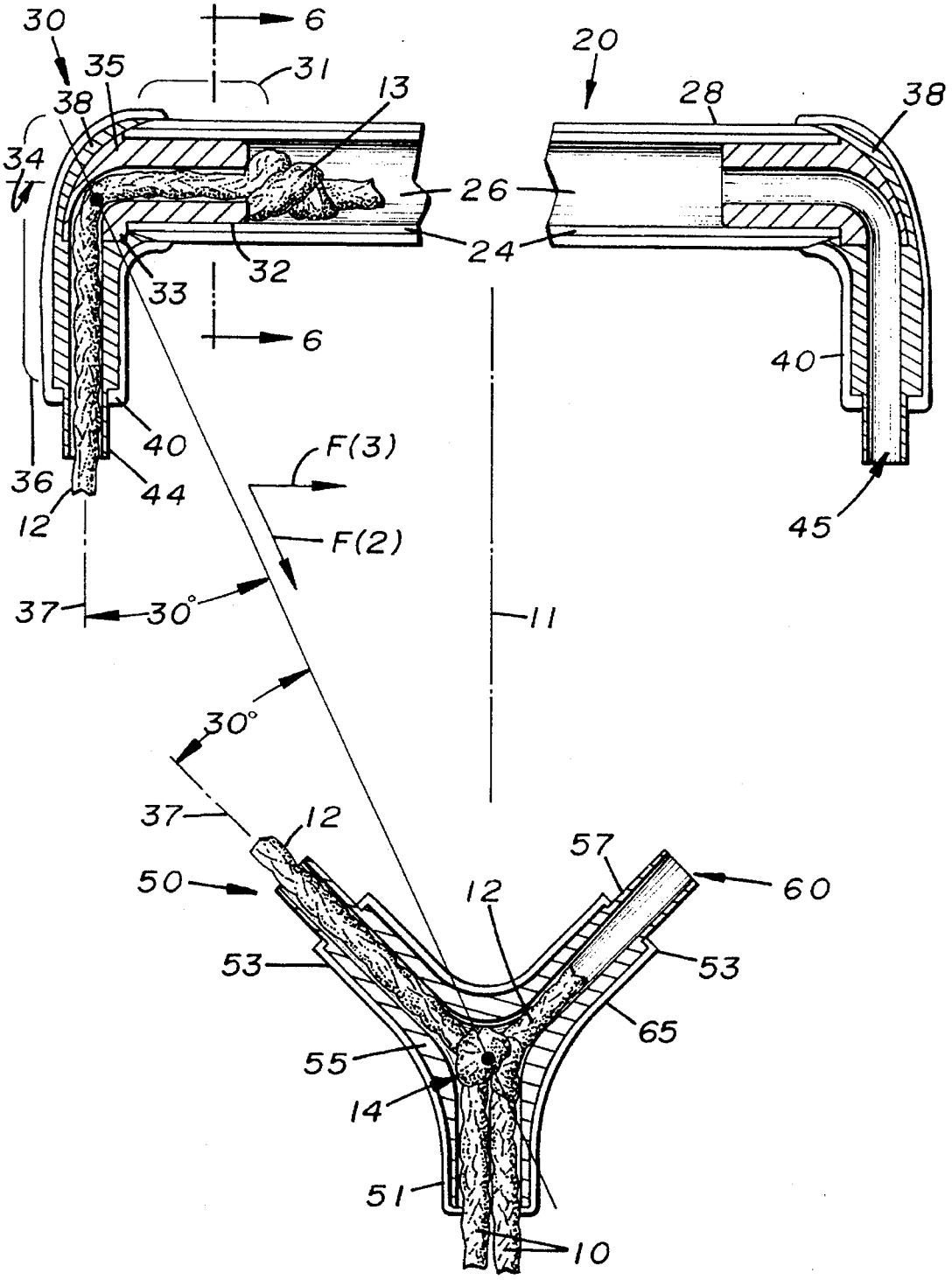
FIG. 2 is a sectional, top plan view of the handle component and the optional yoke member.
Figure 3:
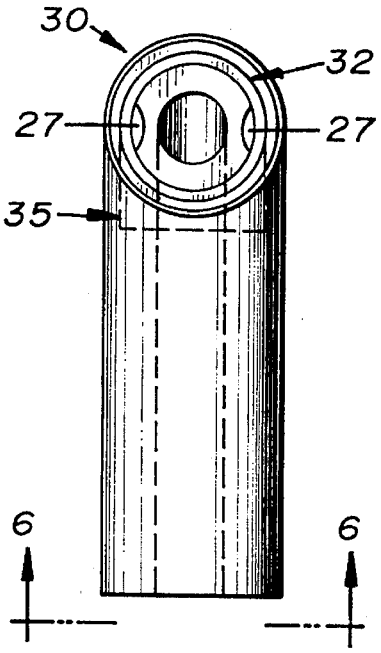
FIG. 3 is a side elevational view of the corner strut shown in FIG. 2.
Figure 4:
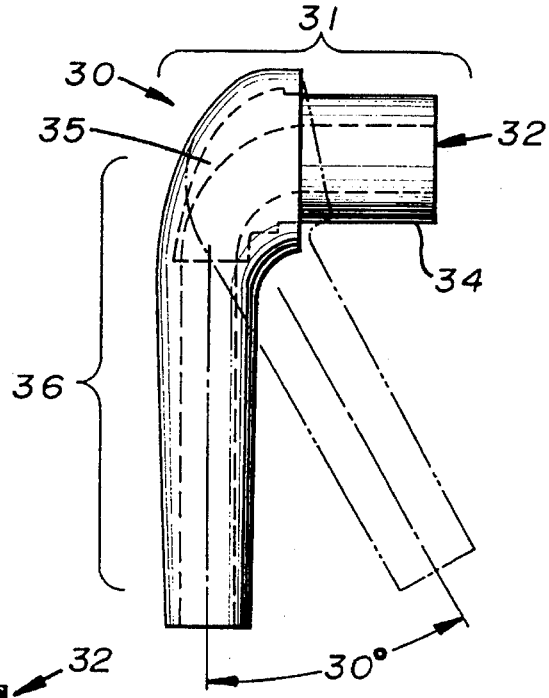
FIG. 4 is a top plan view of the corner strut shown in FIGS. 2 and 3.

The handle system 5 comprises a handle component 20 designed to be held by one or both hands of the user. The handle component 20 comprises a hollow tube 24 made of strong lightweight material, such as aluminum, with two load bearing, L-shaped corner struts 30 inserted into the open ends thereof. The hollow tube 24 may be slightly curved, as shown in FIG. 1, or it may be straight, as shown in FIG. 2. An optional sleeve 21 made of rubber or some other suitable material with a textured surface may be placed over the tube 24 to provide a gripping surface.

As shown more clearly in FIGS. 2–5, each corner strut 30 includes a short leg member 31 and a perpendicularly aligned long leg member 36. The short leg member 31 comprises a bushing member 32 designed to be inserted into an open end on the tube 24. The proximal end of the bushing member 32 is slightly smaller and complimentary in shape to the inside surface of the tube 24 thereby enabling the bushing member 32 to be forcibly inserted into the tube 24. Located at approximately the mid-point of each bushing member 32 is a raised, circular shoulder 33 which prevents the entire bushing member 32 from being inserted into the tube 24. Each bushing member 32 is made of relatively smooth, lightweight, rigid material capable of withstanding at least 240 lbs of tension or torque. In the preferred embodiment, each bushing member 32 is made of relatively high durometer urethane material capable of being molecularly bonded to the first molded layer 38 on the long leg member 36 discussed further below. The urethane material has a hardness of 55D.

Figure 6:
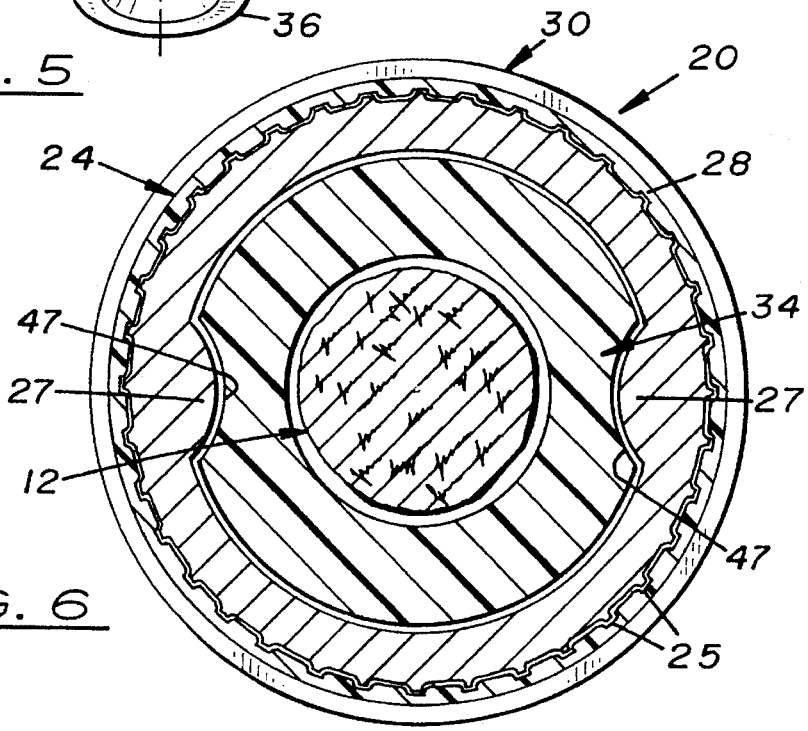
FIG. 6 is a sectional, side elevational view of the handle component taken along line 6—6 in FIG. 2.

As shown in FIG. 6, located radially around the peripheral edge of the proximal end of the bushing member 32 are two optional keyways 27 which interconnect with keys 47 manufactured on the inside surface of the tube 24. During assembly, the bushing member 32 is oriented on the end of the tube 24 so that the keyways 27 can engage the keys 47 and prevent independent rotation of the corner strut 30 on the tube 24. In other embodiments, a suitable adhesive may be used to fix the bushing member 32 to the inside surface of the handle component 20.

Referring again to FIG. 2, the distal portion 35 of the bushing member 32 extends laterally approximately ¾ inch from the end of the handle component 20. Formed over the distal portion 35 is the perpendicularly aligned long leg member 36. When the bushing member 32 is inserted into the end of the handle component 20, the long leg member 36 projects in a forward direction, substantially parallel to the longitudinal axis 11 of the main tow line 10. The distal end 44 of the long leg member 36 terminates approximately 2 inches from the longitudinal axis 34 of the bushing member 32.

Each corner strut 30 is designed to partially absorb the tension force exerted on the branching tow line 12. As shown in FIGS. 1 and 2, when tension force F(1) is exerted on main tow line 10 when skiing, approximately one-half of it, denoted F(2), is exerted on each branch tow line 12. Since each branch tow line 12 intersects at one end to the main tow line 10 at the intersection 14 and at the opposite end to the handle component 20, an inward directed force F(3) is exerted on each branch tow line 12. The long leg member 36 on each corner strut 30 is designed to resist the inward directed force F(3) exerted on the branch tow line 12. In the preferred embodiment, the unique shape and materials used to manufacture the long leg member 36, enables it to bend inward up to approximately 30 degrees towards the extended longitudinal axis 11 of the main tow line 10 when approximately 250 lbs of tension force F(2) is exerted on the branch tow line 12. When this amount of force is exerted on the branch tow line 12, the longitudinal axis of the long leg member 36 pivots and aligns with the center axis of the intersection 14.

In the preferred embodiment, the long leg member 36 comprises a first molded layer 38 which acts as a dynamic layer which enables the long leg member 36 to bend inward when sufficient inward directed force is exerted thereon by the branch tow line 12. Formed over the first molded layer 38 is a second molded layer 40 which acts as a traction and gripping layer to the strut. Both the first and second molded layers 38, 40 are molded over the rigid bushing member 32 which provides rigidity and bares the force load of the branching tow line. In the preferred embodiment, the bushing member 32 consists of a long glass fiber filled, thermoplastic alloy material, such as the product sold under the trademark ISOPLAST by Dow Chemical, with a shore hardness value between 55 to 90 Rockwell. The first molded layer 38 is made of a polyurethane material with a shore hardness value between 90-A to 60-D durometer. The second molded layer 40 is made of polyurethane material with a shore hardness value between 55-A to 90-A durometer. During manufacturing, the first molded layer 38 is molecularly bonded to the distal portion of the bushing member 32 and the second molded layer 40 is then molecularly bonded to the first molded layer 38. When manufacturing is completed, an integral formed, durable, rigid, yet selectively flexible, corner strut 30 is produced.

Figure 5:
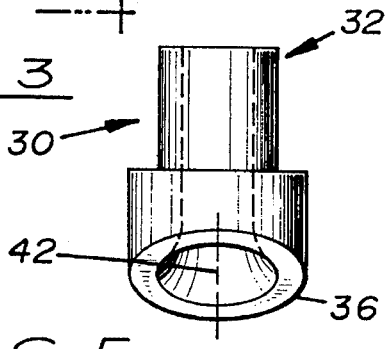
FIG. 5 is a bottom plan view of the corner strut shown in FIGS. 2–4.

As shown in FIG. 5, the long leg member 36 in cross section is oval-shaped with its "z" axis 42 aligned to intersect the extended longitudinal axis 11 of the main tow line 10. The inner passageway 45 formed inside the corner strut 30 has sufficient diameter so that the branch tow line 12 may be extended therethrough.

The handle system 5 may be used with two main tow lines or with one main tow line with a Y-shaped bridle section attached at one end. When used with a Y-shaped bridle section, the handle system 5 may also include a flexible yoke member 50, shown in FIGS. 1 and 3, also designed to partially absorb the tension forces F(1) generated thereon while skiing.

In the preferred embodiment, the yoke member 50 comprises an inner molded layer 55 molecularly bonded with an outer molded layer 65 made of the same material used to manufacture the first and second molded layers 38, 40, respectively, on the long leg member 36. An inner passageway 60 is manufactured in the yoke member 50 which extends through the main leg 51 and diverges to form a branching passageway inside each branching leg 53.

To protect the section of branch tow line 12 located between the distal end of the corner strut 30 and the proximal ends of the branching leg 53, a protective sleeve 70 made of flexible material is provided.

When installing the corner strut 30 on the handle component 20, the end of the branch tow line 12 passes through the inner passageway 45. In the preferred embodiment, the end of the branch tow line 12 is tied into a large knot 13 to prevent the branch tow line 12 from being pulled back through the corner strut 30. In other embodiments, the distal end of the branch tow line 12 may be tied to the distal end of the branch tow line 12 extending through the corner strut 30 located on the opposite end of the handle component 20 or attached to a metal bushing (not shown). After securing the branch tow line 12 to the corner strut 30, the bushing member 32 is aligned on the tube 24 so that when the complementary keys 27 and keyways 47 are engaged, the long leg member 38 projects forward in a direction parallel to the main tow line 10.

While water skiing, the tension force F(2) exerted on the branch tow lines 12 creates an inward directed lateral force F(3) which causes the branching legs 53 on the yoke member 50 to bend inward up to approximately 30 degrees toward the extended longitudinal axis 11 of the main tow line 10. Since the branching legs 53, like the long leg members 36 on the corner strut 30, are resistant to bending, tension force F(2) exerted on the branch tow lines 12 is thereby partially reduced. When the tension force F(2) on the branching tow lines 12 is reduced, the branching legs 53 return to their normal position.

Figure 7:
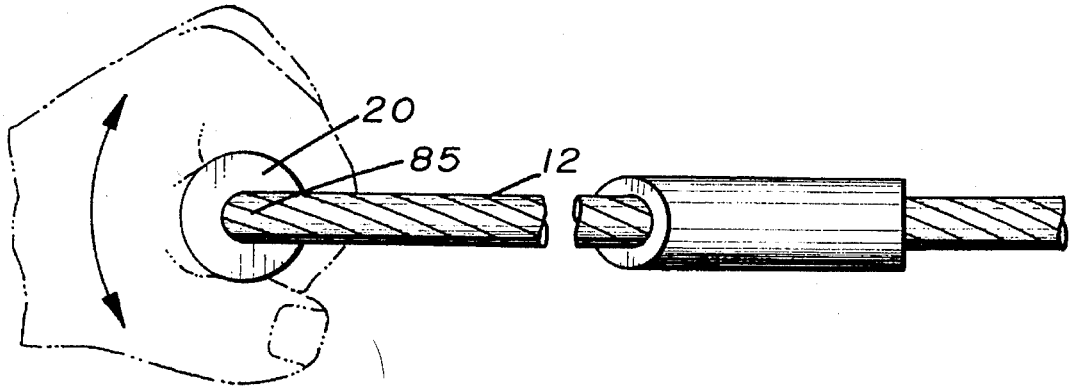
FIG. 7 is an illustration showing the end of the branch tow line being extended into the end of a standard water ski handle.
Figure 8:
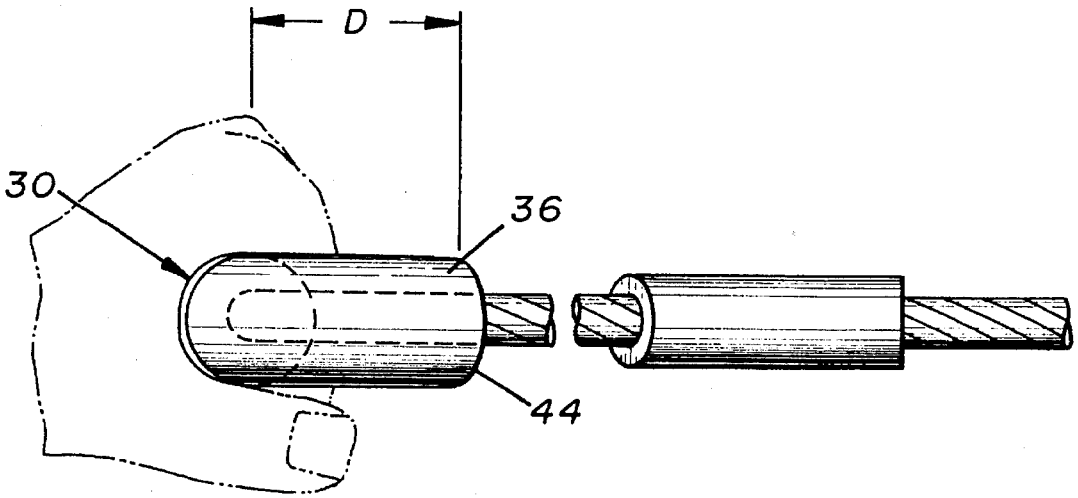
FIG. 8 is an illustration showing the end of the branch tow line being extended into the corner strut used with the water ski handle system disclosed herein.

Another important feature of the handle system 5 is that it provides greater control for the water skier. This is achieved by positioning the fulcrum 85 between each branch tow line 12 and the end of the handle component 20 in a positioned forward to the handle component's center axis 22. When skiing, the handle component 20 has a tendency to rotate in the skier's hand. When the torque is excessive, the skier loses his or her grip allowing the handle component 20 to rotate, which may cause the skier to lose control. As shown in FIG. 7, when the branch tow line 12 is attached directly to the end of the handle component 20, the fulcrum 85 between the handle component 20 and the branch tow line 12 is registered with the handle component's axis. When the fulcrum 85 between the handle component 20 and the branch tow line 12 is located at the distal end 44 of the long leg member 36, as shown in FIG. 8, the length of the lever arm, denoted "D", is increased, which gives the user a mechanical advantage to overcome the torque forces create on the handle component 20 and to maintain his or her grip thereon.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A water ski handle system, comprising:

a. a y-shaped tow rope having a main line and two branch tow lines which diverge at an intersection, said main tow line having an extended longitudinal axis;

b. an elongated handle component, said handle component having two opposite ends, each said end having a central axis, and;

c. two L-shaped corner struts, each said corner strut capable of attaching to one said end of said handle component, each said corner strut having an inner passageway formed therein enabling one said branch tow line to pass through said corner strut, each said corner strut includes a rigid, inner bushing member and an integrally formed long leg member, said bushing member having a proximal end and a distal portion, said proximal end of said bushing member capable of attaching to said end of said handle component to attach said corner strut thereto and said distal portion extends laterally from said end of said handle component, said long leg member being perpendicularly aligned with said bushing member and having a sufficient length so that said branch tow line exits from said long leg member at a position forward of said central axis of said end of said handle component, said long leg member being oval shape in cross-section and sufficiently rigid to resist rotational forces exerted on said handle component and being sufficiently flexible to bend inward towards said extended longitudinal axis of said tow line when sufficient tension force is applied to said branch tow line passing therethrough during use.

2. A water ski handle system as recited in claim 1, wherein said bushing member is made of thermoplastic material.

3. A water ski handle system as recited in claim 2, wherein said bushing member is made of a glass fiber filled, thermoplastic alloy material.

4. A water ski handle system as recited in claim 2, wherein said long leg member includes a first molded layer formed over the distal portion of said bushing member, said first molded layer has a Shore hardness between 90-A to 70-D durometer.

5. A water ski handle system as recited in claim 2, wherein said long leg member further includes a second molded layer formed over said first molded layer.

6. A water ski handle system as recited in claim 5, wherein said second molded layer has a Shore hardness between 35-A to 90-A durometer.

7. A water ski handle system as recited in claim 6, wherein said second molded layer is made of a thermo-plastic rubber.

8. A water ski handle system as recited in claim 1, wherein said corner strut is attached to said handle component by forcing said distal end of said bushing member into said opening on said handle component.

9. A water ski handle system as recited in claim 8, wherein said distal end of said bushing member and said opening are complementary in shaped enabling said bushing member to be radially locked in position on said handle component.

10. A water ski handle system as recited in claim 9, wherein said opening and said bushing member have complementary shaped keys and keyways formed thereon which enable said bushing member to be radially locked in position on said handle component.

11. A water ski handle system as recited in claim 1, further including a yoke member disposed over the intersection of said Y-shaped tow rope, said yoke member having two branching legs disposed over said two branch tow lines, said branching legs being axially aligned approximately 90 degrees apart, said yoke member capable of flexing to allow said branching legs to converge when a sufficient amount of tension force is applied to said two branch tow lines during use.

12. A water ski handle system as recited in claim 11, wherein said yoke member includes an inner molded layer and a outer molded layer, said inner molded layer being made of a resilient but firm material while said second molded layer being made of material more flexible than said inner molded layer.

13. A water ski handle system as recited in claim 12, wherein said inner molded layer has a Shore hardness between 90-A to 70-D durometer.

14. A water ski handle system as recited in claim 12, wherein said outer mold layer has a Shore hardness between 35-A to 90-A durometer.

15. A water ski handle system, comprising:

a. a y-shaped tow line having a main line and two branch two lines which diverge at an intersection, said main line having an extended longitudinal axis;

b. an elongated handle component, said handle component having two opposite ends;

c. two L-shaped corner struts, each said corner strut capable of being attached to one said end of said handle component, each said corner strut having an L-shaped, inner passageway formed therein enabling one said rope member to pass through said corner strut, each said corner strut includes a rigid, inner bushing member and an integrally attached long leg member, said bushing member having a proximal end and a distal portion, said proximal end of said bushing member capable of attaching to said end of said handle component to securely attach said corner strut thereto and said distal portion extends laterally from said end of said handle component, said long leg member being perpendicularly aligned with said bushing member and having a sufficient length so that said branch tow line exits from said long leg member at a position forward of said longitudinal axis of said handle component, said long leg member being oval shape in cross-section and sufficiently rigid to resist rotational forces exerted on said handle component and sufficiently flexible to bend inward towards said extended longitudinal axis of said main tow line when sufficient tension force is applied to said branch tow line passing therethrough during use, and;

d. a yoke member disposed over said intersection of said Y-shaped tow rope, said yoke member having two branching legs aligned approximately 90 degrees apart, said branching legs being capable of bending towards said extended axis of said main line when sufficient tension force is exerted on said branch tow lines.

16. A water ski handle system as recited in claim 15, wherein said long leg member includes a first molded layer formed over the distal portion of said bushing member, said first molded layer has a Shore hardness between 90-A to 70-D durometer.

17. A water ski handle system as recited in claim 16, wherein said long leg member further includes a second molded layer formed over said first molded layer.

18. A water ski handle system as recited in claim 17, wherein said second molded layer has a Shore hardness between 35-A to 90-A durometer.

19. A water ski handle system as recited in claim 17, wherein said yoke member includes an inner molded layer and a outer molded layer, said inner molded layer being made of a resilient but firm, flexible material while said second over molded layer being made of a more flexible material.

20. A water ski handle system as recited in claim 19, wherein said inner molded layer has a Shore hardness between 90-A to 70-D durometer.

21. A water ski handle system as recited in claim 19, wherein said second over-molded layer has a shore hardness between 35-A to 90-A durometer.

* * * * *